US010290457B1

(12) United States Patent
Lasini et al.

(10) Patent No.: US 10,290,457 B1
(45) Date of Patent: May 14, 2019

(54) INNER CAP FOR HIGH VOLTAGE FUSE

(71) Applicant: Littelfuse, Inc., Chicago, IL (US)

(72) Inventors: Derek Lasini, Chicago, IL (US); Michael Schlaak, Chicago, IL (US)

(73) Assignee: Littelfuse, Inc., Chicago, IL (US)

( * ) Notice: Subject to any disclaimer, the term of this patent is extended or adjusted under 35 U.S.C. 154(b) by 0 days.

(21) Appl. No.: 15/954,259

(22) Filed: Apr. 16, 2018

Related U.S. Application Data

(63) Continuation of application No. 15/862,796, filed on Jan. 5, 2018.

(51) Int. Cl.

| | |
|---|---|
| ***H01H 85/22*** | (2006.01) |
| ***H01H 85/143*** | (2006.01) |
| ***H01H 85/38*** | (2006.01) |
| ***H01H 85/60*** | (2006.01) |
| ***H01H 85/042*** | (2006.01) |

(52) U.S. Cl.
CPC ..... *H01H 85/22* (2013.01); *H01H 85/042* (2013.01); *H01H 85/143* (2013.01); *H01H 85/38* (2013.01); *H01H 85/60* (2013.01)

(58) Field of Classification Search
CPC .. H01H 85/042; H01H 85/143; H01H 85/157; H01H 85/22; H01H 85/60
USPC ..... 337/248
See application file for complete search history.

(56) References Cited

U.S. PATENT DOCUMENTS

| | | | | |
|---|---|---|---|---|
| 1,087,853 | A * | 2/1914 | Urquhart | H01H 85/143 337/251 |
| 3,270,168 | A * | 8/1966 | Eric Jacks | H01H 85/042 337/161 |
| 5,115,220 | A * | 5/1992 | Suuronen | H01H 85/157 337/152 |
| 5,994,994 | A * | 11/1999 | Ito | H01H 85/0418 337/228 |
| 6,798,330 | B2 * | 9/2004 | Arikawa | H01H 85/0418 337/187 |
| 2005/0168315 | A1 * | 8/2005 | Brown | H01H 85/05 337/248 |
| 2009/0021339 | A1 * | 1/2009 | Haas | H01H 85/003 337/248 |
| 2012/0068810 | A1 * | 3/2012 | Spalding | H01H 85/157 337/248 |

* cited by examiner

*Primary Examiner* — Jacob R Crum

(57) ABSTRACT

Provided herein are protection devices, such as fuses. In some embodiments, a fuse may include a hollow body having first and second ends, each of the first and second ends having an end surface and a side surface extending from the end surface. The fuse may further include a fusible element disposed within a central cavity of the hollow body, the fusible element extending between the first and second ends. The fuse may further include an inner cap formed over at least one of the first and second ends. The inner cap may include a center portion in contact with the fusible element, and a plurality of spring legs extending from the center portion, wherein the plurality of spring legs is in contact with the side surface of the first and/or second ends. The fuse may further include endcaps surrounding the first and second ends.

20 Claims, 5 Drawing Sheets

INNER CAP FOR HIGH VOLTAGE FUSE

CROSS-REFERENCE TO RELATED APPLICATION

Field

This application is a continuation of U.S. patent application Ser. No. 15/862,796, filed Jan. 5, 2018, the entire contents of which are incorporated herein by reference.

BACKGROUND

Field

The present disclosure relates generally to fuses. More specifically, the present disclosure relates to high voltage fuses that include an inner cap disposed over a hollow fuse body.

Description of Related Art

Fuses are used as circuit protection devices and form an electrical connection with the component in a circuit to be protected. One existing fuse design includes a hollow fuse body, a fusible element disposed within the hollow body, and an endcap connected to each end of the fusible element. During one assembly approach, a solder preform is provided underneath the endcap, and heated until the solder reflows between the endcap and the fusible element. During another assembly approach, a slot may be cut in the endcap to allow solder to be injected into the endcap and over the fusible element. However, both assembly approaches are difficult to accurately control, and to validate that a good connection between the fusible element and the endcap has been formed.

Furthermore, some existing fuse designs insert the fusible element into a round body, and then bend the fuse element over an edge of the round body. Once the endcap is secured to the hollow fuse body, the fusible element is forced against the edge, which may be flat/sharp, thus increasing the likelihood of damage to the fusible element. It is with respect to these and other considerations that the present disclosure is provided.

SUMMARY

In one or more approaches according to the disclosure, a fuse may include a hollow body including a first end and a second end, each of the first and second ends having an end surface and a side surface extending from the end surface. The fuse may further include a fusible element disposed within a central cavity of the hollow body, the fusible element extending between the first and second ends. The fuse may further include an inner cap formed over at least one of the first and second ends. The inner cap may include a center portion in contact with the fusible element, and a plurality of spring legs extending from the center portion, wherein the plurality of spring legs is in contact with the at least one of the first and second ends. The fuse may further include a first endcap surrounding the first end and a second endcap surrounding the second end.

In one or more approaches according to the disclosure, a protection device may include a hollow body including a first end and a second end, the first end including a first end surface and a first side surface extending from the first end surface, and the second end including a second end surface and a second side surface extending from the second end surface. The protection device may further include a fusible element disposed within a central cavity of the hollow body, the fusible element extending between the first and second ends. The protection device may further include a first inner cap formed over the first end, and a second inner cap formed over the second end. The first and second inner caps may each include a center portion in contact with the fusible element, and a plurality of spring legs extending from the center portion. The plurality of spring legs of the first inner cap may be in contact with the first side surface, and the plurality of spring legs of the second inner cap may be in contact with the second side surface. The protection device may further include a first endcap surrounding the first end and a second endcap surrounding the second end.

In one or more approaches according to the disclosure, a protection device may include a hollow body including a first end and a second end, the first end including a first end surface and a first side surface extending from the first end surface, and the second end including a second end surface and a second side surface extending from the second end surface. The protection device may further include a fusible element disposed within a central cavity of the hollow body, the fusible element extending between the first and second ends. The protection device may further include a first inner cap formed over the first end, and a second inner cap formed over the second end, wherein the fusible element is connected to each of the first and second inner caps. The first and second inner caps may each include a center portion having a central opening receiving the fusible element, and a plurality of spring legs extending from the center portion. The plurality of spring legs of the first inner cap may be in contact with the first side surface, and the plurality of spring legs of the second inner cap may be in contact with the second side surface. The protection device may further include a first endcap surrounding the first end and a second endcap surrounding the second end, wherein the plurality of spring legs of the first inner cap are in contact with the first endcap, and wherein the plurality of spring legs of the second inner cap are in contact with the second endcap.

BRIEF DESCRIPTION OF THE DRAWINGS

The accompanying drawings illustrate exemplary approaches of the disclosed embodiments so far devised for the practical application of the principles thereof, and in which.

Figure 1:
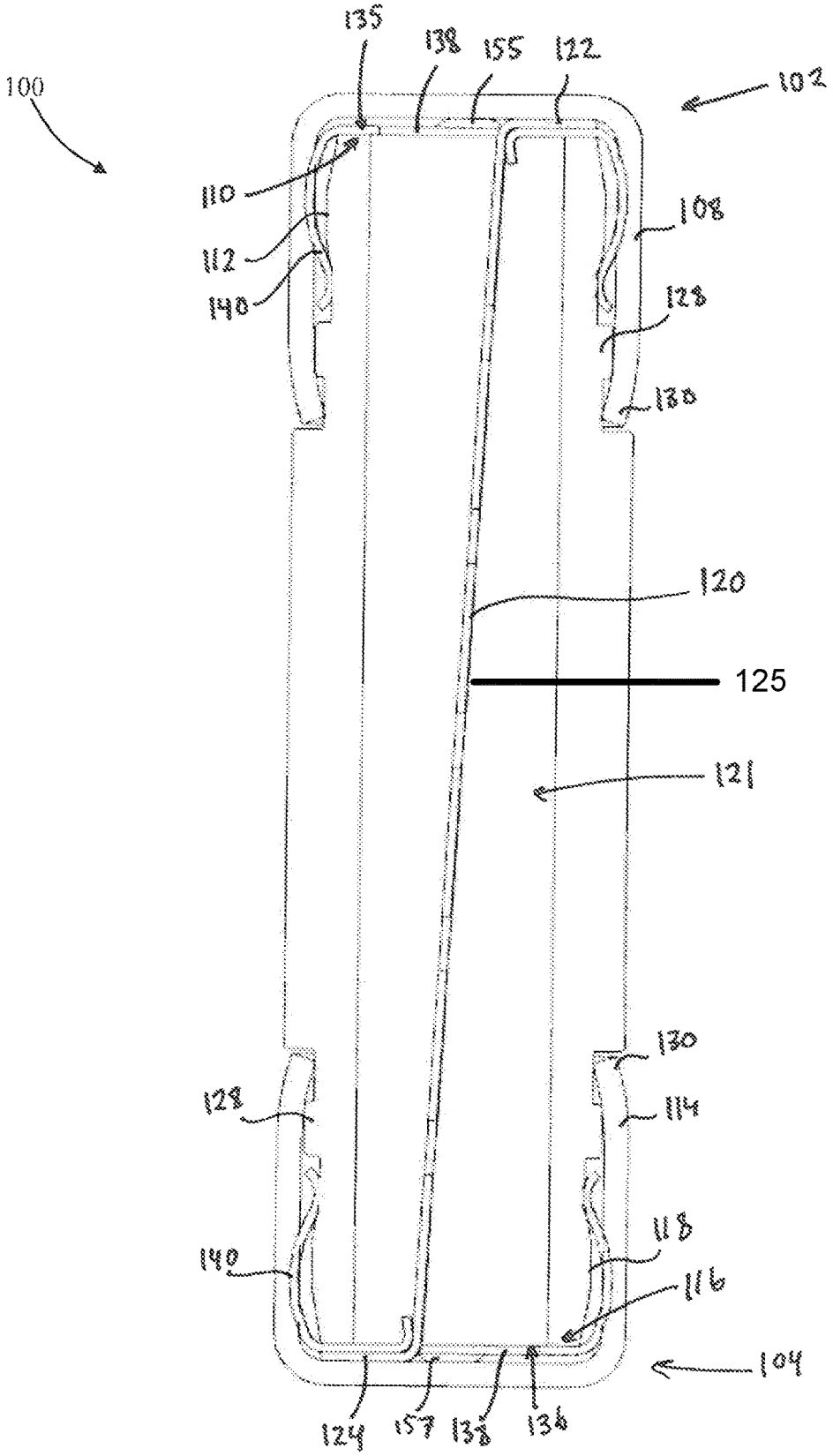
FIG. 1 illustrates a side cross-sectional view of a fuse according to embodiments of the disclosure.

The drawings are not necessarily to scale. The drawings are merely representations, not intended to portray specific parameters of the disclosure. The drawings are intended to depict typical embodiments of the disclosure, and therefore should not be considered as limiting in scope. In the drawings, like numbering represents like elements.

Furthermore, certain elements in some of the figures may be omitted, or illustrated not-to-scale, for illustrative clarity. Furthermore, for clarity, some reference numbers may be omitted in certain drawings.

DETAILED DESCRIPTION

Embodiments in accordance with the present disclosure will now be described more fully hereinafter with reference to the accompanying drawings. The fuse and protection device may be embodied in many different forms and should not be construed as being limited to the embodiments set forth herein. Rather, these embodiments are provided so that this disclosure will be thorough and complete, and will fully convey the scope of the system and method to those skilled in the art.

For the sake of convenience and clarity, terms such as "top," "bottom," "upper," "lower," "vertical," "horizontal," "lateral," and "longitudinal" will be used herein to describe the relative placement and orientation of various components and their constituent parts. Said terminology will include the words specifically mentioned, derivatives thereof, and words of similar import.

As used herein, an element or operation recited in the singular and proceeded with the word "a" or "an" should be understood as not excluding plural elements or operations, unless such exclusion is explicitly recited. Furthermore, references to "one embodiment" of the present disclosure are not intended to be interpreted as excluding the existence of additional embodiments that also incorporate the recited features.

As will be discussed in greater detail herein, provided herein are protection devices, such as fuses. In some embodiments, a fuse may include a hollow body having first and second ends, each of the first and second ends having an end surface and a side surface extending from the end surface. The fuse may further include a fusible element disposed within a central cavity of the hollow body, the fusible element extending between the first and second ends. The fuse may further include an inner cap formed over at least one of the first and second ends. The inner cap may include a center portion in contact with the fusible element, and a plurality of spring legs extending from the center portion, wherein the plurality of spring legs is in contact with the at least one of the first and second ends. The fuse may further include endcaps surrounding the first and second ends.

One of more of the following technical advantages may be achieved with the herein disclosed protection devices/fuses. Firstly, the protection devices/fuses herein improve control difficulties because the joint between the fusible element and the inner cap may be inspected before the fuse is fully assembled. Secondly, a spring-force causes the spring legs of the inner cap to make a physical and electrical connection with the endcap. Unlike a press-fit inner cap to outer cap connection of existing fuses, the spring force of the presently disclosed inner cap reduces the need for as tight of tolerance control for both the body of the fuse and the endcaps. Thirdly, the inner cap may include one or more standoff features, which physically prevent the endcap from putting excessive force on the fusible element. In some cases, an air gap between the fusible element and the endcap is present.

FIG. 1 illustrates a side cross-sectional view of a protection device or fuse 100 in accordance with non-limiting embodiments of the present disclosure. The fuse 100 may have a generally circular profile in cross-section, as viewed end-on from a first end 102 or a second end of the fuse 100. Alternatively, the fuse 100 may have a generally rectangular profile in cross-section, as viewed end-on from the first or second ends 102, 104. The fuse 100 may be implemented with other shape profiles as well. As shown, the fuse 100 may have a hollow body 106. The hollow body 106 may be ceramic, plastic, or other suitable electrically non-conducting material. A first endcap 108 may be disposed over a first end surface 110 and a first side surface 112 of the hollow body 106, and a second endcap 114 may be disposed over a second end surface 116 and a second side surface 118 of the hollow body 106.

The fuse 100 further includes a fusible element 120, such as wire. The fusible element 120 may be disposed within a central cavity 121 defined by the hollow body 106. Furthermore, the fusible element 120 may include a first end 122 extending partially across the first end surface 110, and a second end 124 extending partially across the second end surface 116. In some embodiments, the fusible element 120 may be connected/attached to first and second inner caps 135 and 136 prior to being covered by the first and second endcaps 108, 114. The first end 122 and the second end 124 of the fusible element 120 may be connected to the first and second inner caps 135 and 136, respectively, by laser welding, soldering, spot welding, mechanical connection (e.g., rivets), brazing, or by any other suitable method. As shown, the first and second ends 122, 124 of the fusible element 120 are parallel, or substantially parallel, to one another, while a central portion 125 of the fusible wire extends diagonally through the central cavity 121. It will be appreciated that other types and/or configurations of fusible elements may be possible within the scope of the present disclosure.

The hollow body 106 may further include a set of connection rings 128 extending around the exterior thereof. In some embodiments, the set of connection rings 128 are in electrical contact with the first endcap 108 and the second endcap 114, respectively. As shown, the first and second endcaps 108, 114 may each include a sloped open end 130 extending towards the hollow body 106.

As shown, the inner cap 135 may be disposed over the first end 102, and the second inner cap 136 may be disposed over the second end 104. In some embodiments, the first and second inner caps 135, 136 may each include a center portion 138 in contact with the fusible element 120, wherein the center portion 138 extends over the first end surface 110 and the second end surface 116, respectively. As shown, the center portion 138 may be in direct physical contact with the hollow body 106, along the first and second end surfaces 110, 116. Each of the first inner cap 135 and the second inner cap 136 may further include a plurality of spring legs 140 extending from the center portion 138. The plurality of spring legs 140 of the first inner cap 135 may be in direct physical contact with the first side surface 112, while the plurality of spring legs 140 of the second inner cap 136 may similarly be in direct physical contact with the second side surface 118. The plurality of spring legs 140 may be made from any suitable spring material, such as copper or aluminum. Embodiments herein are not limited to any particular material, however. For example, in some embodiments, the plurality of spring legs 140 may be created from non-spring-temper.

As will be described in greater detail below, the center portion 138 of the first inner cap 135 may include a first standoff feature 155 extending towards the first endcap 108, and the center portion 138 of the second inner cap 136 includes a second standoff feature 157 extending towards the second endcap 114. In exemplary embodiments, the first and second standoff features 155, 157 makes contact with the first and second endcaps 108 and 114, respectively.

Figure 2:
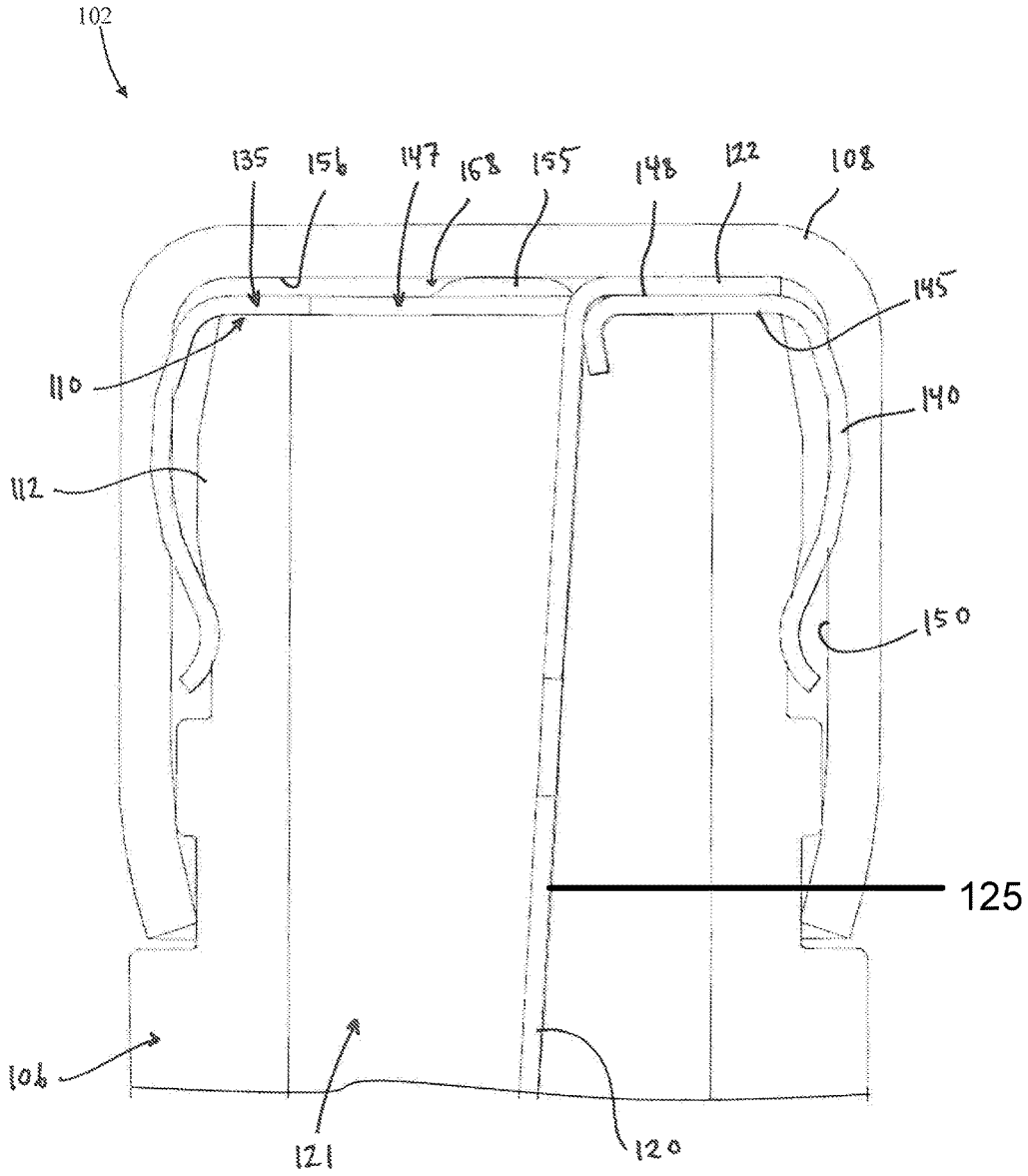
FIG. 2 illustrates a side cross-sectional view of an exemplary end of the fuse of FIG. 1 according to embodiments of the disclosure.
Figure 3:
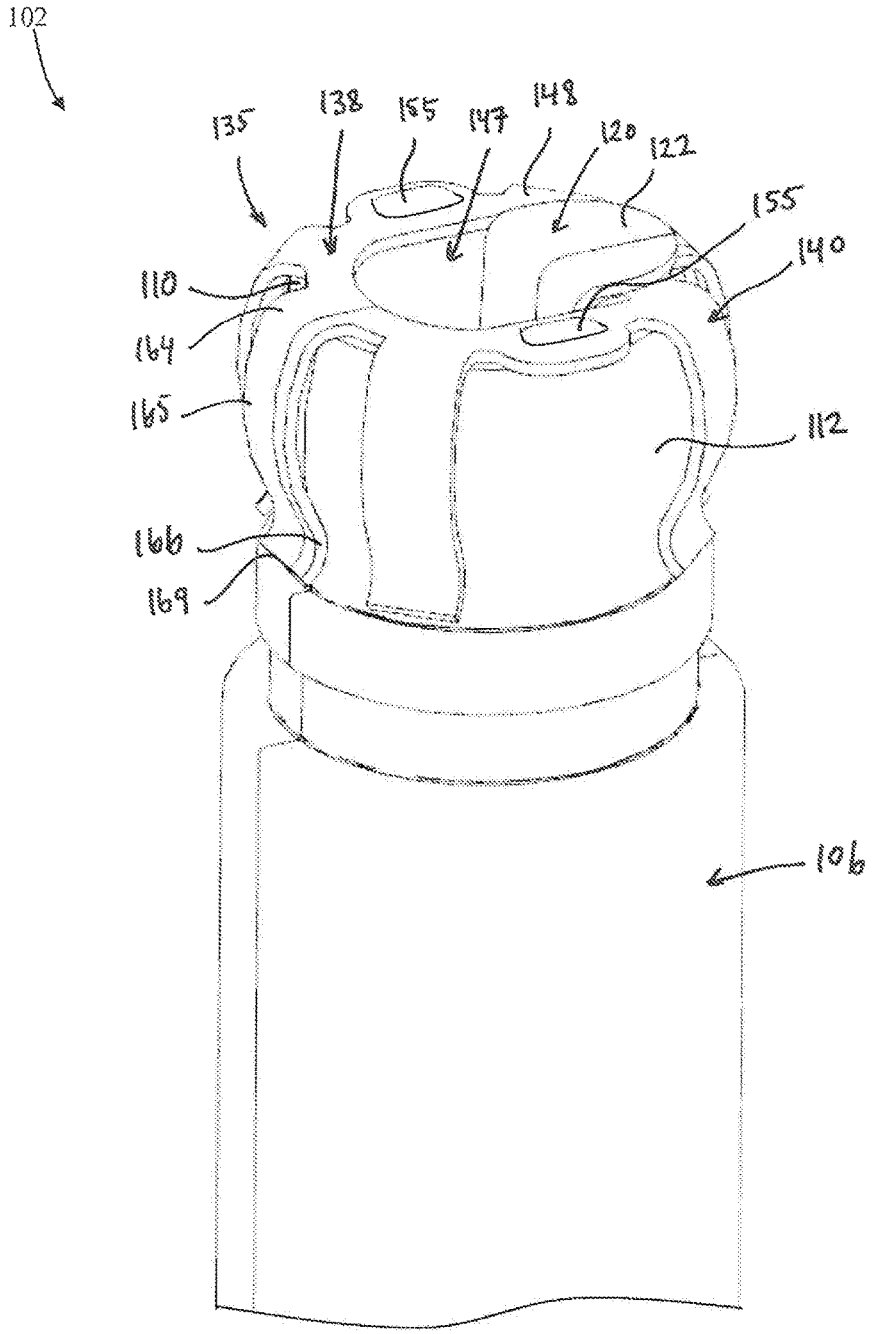
FIG. 3 illustrates a perspective view of an exemplary inner cap disposed over an end of a fuse according to the embodiments of the disclosure.

Turning now to FIGS. 2-3, the fuse 100 will be described in greater detail. FIG. 2 illustrates a close-up side cross-sectional view of the first end 102 of the fuse 100 of FIG. 1. FIG. 3 illustrates a perspective view of the first end 102 of the fuse 100 of FIG. 1 with the first endcap 108 removed for ease of viewing. Although only the first end 102 will hereinafter be described, it will be appreciated that the second end 104 of the fuse 100 may share all the same components and function in substantially the same way as the first end 102.

As shown, the first inner cap 135 is positioned atop the first end surface 110 of the hollow body 106. Specifically, an inner surface 145 of the center portion 138 may be in abutment with the first end surface 110. The first inner cap 135 may include a central opening 147, which receives the fusible element 120 therethrough. In exemplary embodiments, the first end 122 of the fusible element 120 may be bent over the center portion 138, and extend substantially parallel and flush with an outer surface 148 of the center portion 138.

One or more of the plurality of spring legs 140 of the first inner cap 135 may form a physical and electrical connection with an interior surface 150 of the first endcap 108. Furthermore, one or more of the plurality of the spring legs 140 may form a physical connection with the first side surface 112 of the hollow body 106. In an exemplary embodiment, each of the plurality of spring legs 140 is in contact with the interior surface 150 of the first endcap 108 and with the first side surface 112 of the first end 102 of the hollow body 106. As opposed to a press-fit inner-cap to outer-cap connection employed in existing fuses, the spring force of the first inner cap 135 lessens the need for ultra-tight tolerance control of both the first end 102 of the hollow body 106 and of the first endcap 108. The embodiment shown in FIG. 3 of the first inner cap 135 includes six (6) spring legs 140. However, it'll be appreciated that a greater or lesser number of spring legs is possible within the scope of the disclosure.

In some embodiments, the center portion 138 of the first inner cap 135 may further include one or more standoff features 155 extending towards the first endcap 108. As shown, the outer surface 148 of the center portion 138 includes two (2) standoff features 155, which may each be formed as a protrusion or bump-out intended to support the first endcap 108. In exemplary embodiments, the standoff features 155 make physical contact with an inner surface 156 of the first endcap 108 to raise the first endcap above the outer surface 148 of the center portion 138 of the first inner cap 135. A gap 158 is therefore provided between the inner surface 156 of the first endcap 108 and the outer surface 148 of the first inner cap 135. The gap 158 advantageously provides an area for the first end 122 of the fusible element 120. In some embodiments, the standoff features 155 may be tall enough so that a space (not shown) is provided between the first end 122 of the fusible element 120 and the inner surface 156 of the first endcap 108, which may be particularly advantageous in the case the fusible element 120 is thinner and therefore more fragile. By providing the gap 158 for the first end 122 of the fusible element 120, less force may be placed upon the fusible element 120, for example, when the first endcap 108 is brought into position over the first end 102 of the hollow body 106. Although not limited to any particular number or shape, two (2) standoff features 155 may be provided along the center portion 138 to more evenly support the first endcap 108.

Figure 4:
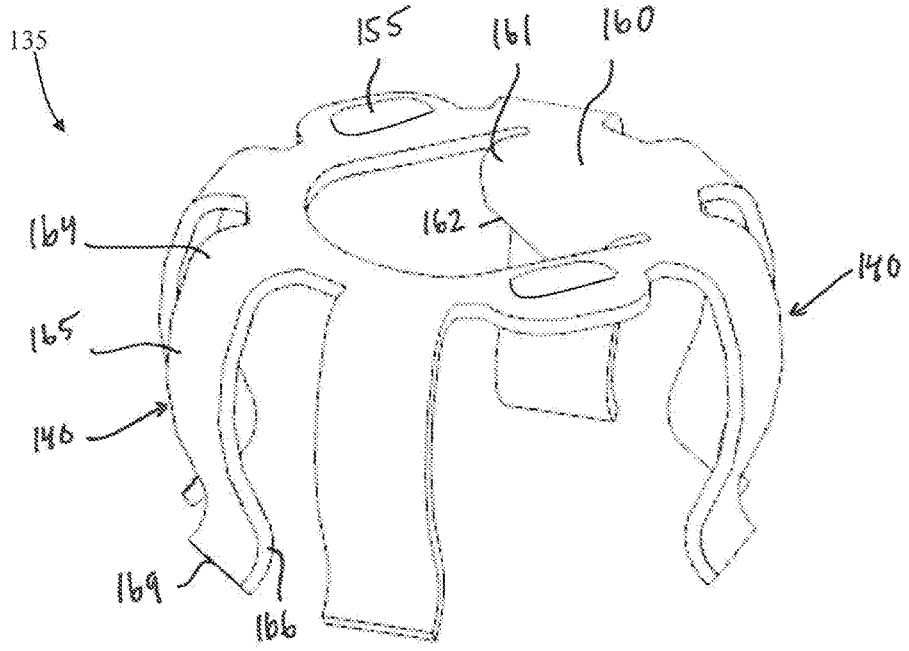
FIG. 4 illustrates a perspective view of an exemplary inner cap according to the embodiments of the disclosure.
Figure 5:
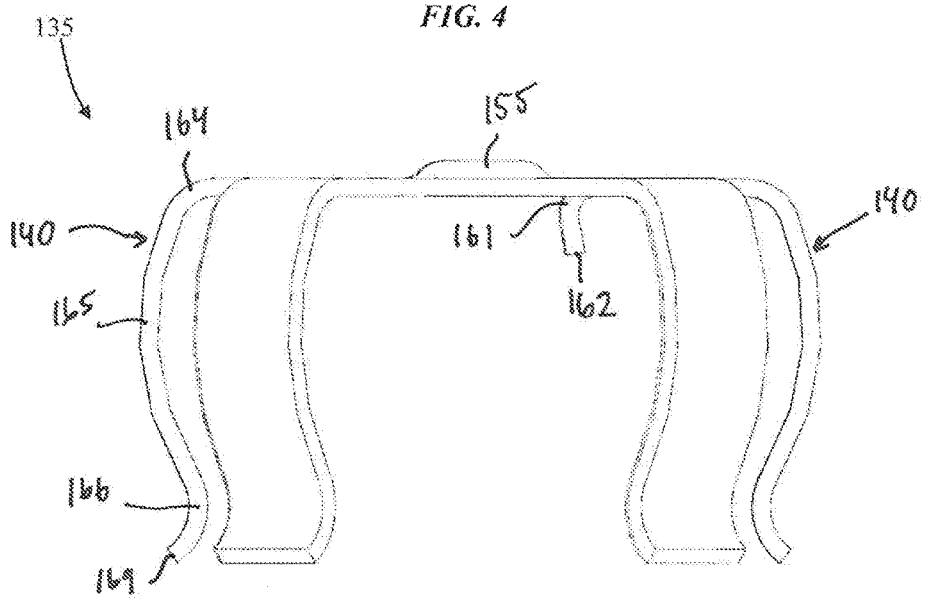
FIG. 5 illustrates a side view of the exemplary inner cap of FIG. 4 according to the embodiments of the disclosure.

Turning now to FIGS. 3-5, the first inner cap 135 will be described in greater detail. As shown, the first inner cap 135 includes the center portion 138, and the plurality of spring legs 140 extending from the center portion 138. The center portion 138 in some embodiments may be circular or ring-shaped to conform to the shape of the first end 102 of hollow fuse body 106. However, in the case the first end 102 is rectangular shaped, for example, the center portion 138 may generally take on a rectangular shape as well. The center portion 138 may include a surface or shelf, which may be a curved or flattened surface 160, operable to receive the first end 122 of the fusible element 120. The center portion 138 may further include a contoured (e.g., bent or rounded) lip 161 extending from the flattened surface 160. The contoured lip 161 is rounded to decrease the likelihood of damage to the fusible element 120 as the fusible element 120 is bent over the first inner cap 135. In some embodiments, a free end 162 extends downwardly from the contoured lip 161. As shown, the free end 162 angles away from the fusible element 120. By angling the free end 162 away from the central opening 147 of the center portion 138, the fusible element 120 is less likely to impact any edges of the free end 162, further reducing opportunity for damage to the fusible element 120. In other embodiments, the free end 162 may extend substantially parallel to a central longitudinal axis extending through the central cavity 121 (FIGS. 1-2). In yet other embodiments, the free end 162 may extend parallel to the central portion 125 (FIGS. 1-2) of the fusible element 120 within the central cavity 121. The center portion 138 may further include the standoff features 155, as described above.

Although not limited to any particular shape, the plurality of spring legs 140 may each include a shoulder 164 extending away from the center portion 138, and a first bend 165 in direct physical and electrical contact with the first endcap (not shown). The plurality of spring legs 140 may each further include a second bend 166 in direct physical contact with the first side surface 112 of the hollow body 106. A free end 169 may extend from the second bend 166, the free end 169 being angled away from the first side surface 112 to allow for ease of assembly between the first inner cap 135 and the first side surface 112. Furthermore, the shape of the plurality of spring legs 140 allows the free end 169 to slide relative to the first side surface 112 as the first inner cap 135 is compressed by the first endcap.

Figure 6:
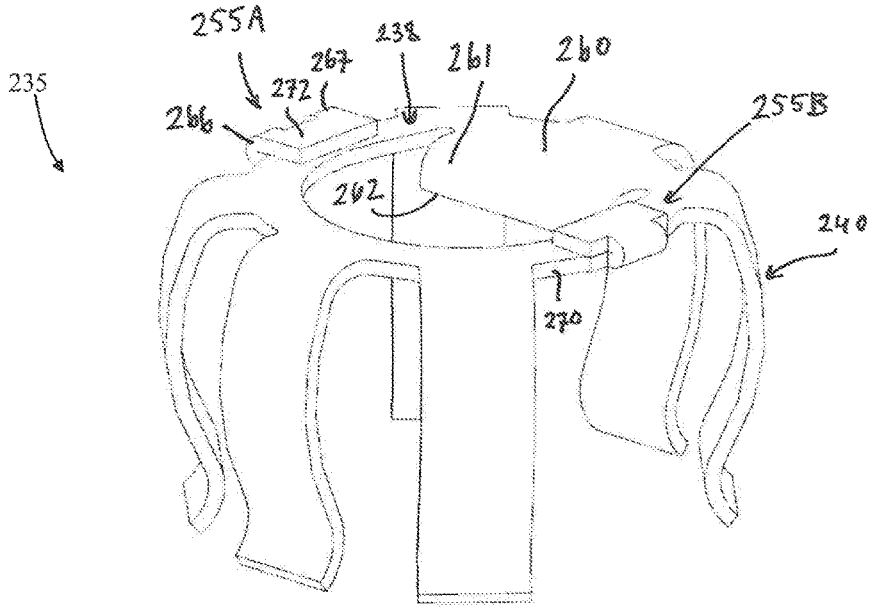
FIG. 6 illustrates a perspective view of another exemplary inner cap according to the embodiments of the disclosure.
Figure 7:
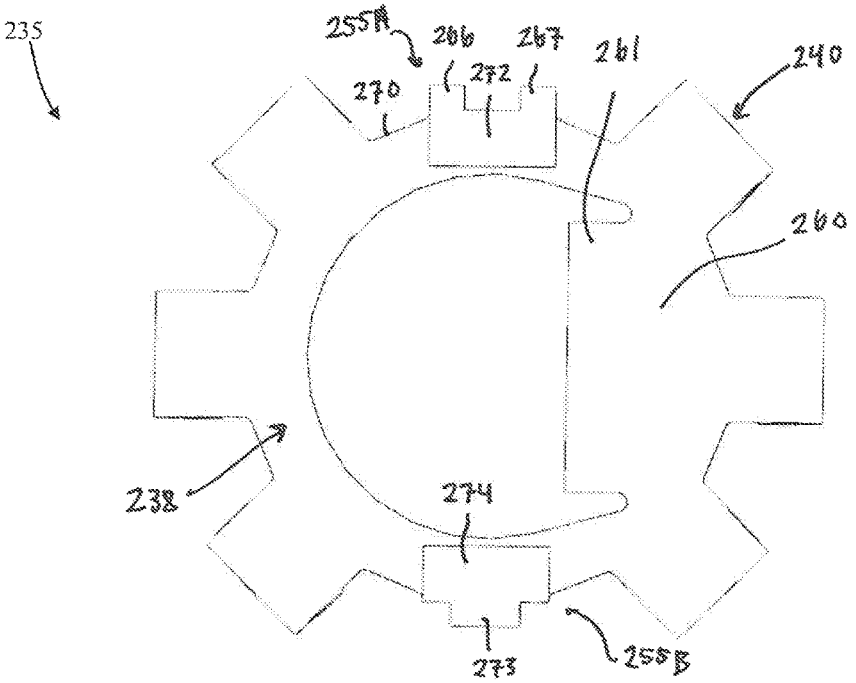
FIG. 7 illustrates a top view of the exemplary inner cap of FIG. 6 according to the embodiments of the disclosure.

Turning now to FIGS. 6-7, an inner cap 235 according to another embodiment of the disclosure will be described in greater detail. The inner cap 235 may be provided in place of the first and/or second inner caps 135, 136 of the fuse 100 described above. As shown, the inner cap 235 includes a center portion 238, and a plurality of spring legs 240 extending from the center portion 238. The center portion 238 may include a flattened surface 260, such as a shelf, operable to receive the first end of the fusible element (not shown). The center portion 238 may further include a contoured lip 261 extending from the flattened surface 260. In some embodiments, a free end 262 extends from the contoured lip 261, wherein the free end 262 angles away from the fusible element.

The center portion 238 may further include one or more standoff features 255A-B, which in this embodiment, may be a layer of material provided atop an outer surface 248 of the center portion 238. As shown, the standoff feature 255A may include a pair of folds 266, 267 extending from an outer face 270 of the center portion 238. The pair of folds 266, 267 connect to a flap 272, which extends along the outer surface 248 of the center portion 238. As shown, the flap 272 abuts the outer surface 248, and is configured to engage an endcap (not shown). The standoff feature 255B may include a center fold 273 connected to a flap 274, wherein the center fold 273 extends from the outer face 270 of the center portion 238. As shown, the flap 274 abuts the outer surface 248, and is configured to engage an endcap (not shown). The standoff features 255A-B provide a gap between an inner surface of the endcap and a fusible element secured to the inner cap 235. It will be appreciated that each of the standoff features 255A-B may be the same or different.

While the present disclosure has been described with reference to certain approaches, numerous modifications, alterations and changes to the described approaches are possible without departing from the sphere and scope of the present disclosure, as defined in the appended claims. Accordingly, it is intended that the present disclosure not be limited to the described approaches, but that it has the full scope defined by the language of the following claims, and equivalents thereof. While the disclosure has been described with reference to certain approaches, numerous modifications, alterations and changes to the described approaches are possible without departing from the spirit and scope of the disclosure, as defined in the appended claims. Accordingly, it is intended that the present disclosure not be limited to the described approaches, but that it has the full scope defined by the language of the following claims, and equivalents thereof.

We claim:

1. A fuse comprising:

a hollow body including a first end and a second end, each of the first and second ends having an end surface and a side surface extending from the end surface;

a fusible element disposed within a central cavity of the hollow body, the fusible element extending between the first and second ends;

an inner cap formed over at least one of the first and second ends, the inner cap comprising:

a center portion having an end face in contact with the fusible element and defining a central opening, the center portion further having a contoured lip with a radius of curvature extending from the end face into the central opening, the fusible element extending over the contoured lip, the contoured lip terminating in a free end that extends away from, and is not in direct, physical contact with, the fusible element such that the fusible element engages only a rounded surface of the contoured lip;

a plurality of spring legs extending from the center portion, the plurality of spring legs in contact with the at least one of the first and second ends; and a first endcap surrounding the first end and a second endcap surrounding the second end.

2. The fuse according to claim 1, wherein one or more of the plurality of spring legs is in physical and electrical contact with at least one of the first endcap and the second endcap.

3. The fuse according to claim 1, wherein the inner cap is formed of sheet metal having a plurality of edges, and wherein the fusible element does not engage any of the edges.

4. The fuse according to claim 1, the contoured lip having a free end that extends away from the fusible element.

5. The fuse according to claim 1, the center portion comprising at least one standoff feature extending away from the hollow body.

6. The fuse according to claim 5, the at least one standoff feature in physical contact with at least one of the first endcap and the second endcap.

7. The fuse according to claim 6, the at least one standoff feature creating a gap between the center portion and at least one of the first endcap and the second endcap.

8. The fuse according to claim 1, each of the plurality of spring legs comprising:

a first bend in direct physical and electrical contact with at least one of the first endcap and the second endcap; and a second bend in direct physical contact with the side surface.

9. The fuse according to claim 8, each of the plurality of spring legs further comprising a free end extending away from the side surface.

10. The fuse according to claim 1, wherein each of the plurality of spring legs is made from a spring material.

11. A protection device comprising:

a hollow body including a first end and a second end, the first end including a first end surface and a first side surface extending from the first end surface, and the second end including a second end surface and a second side surface extending from the second end surface;

a fusible element disposed within a central cavity of the hollow body, the fusible element extending between the first and second ends;

a first inner cap formed over the first end, and a second inner cap formed over the second end, the first and second inner caps each comprising:

a center portion having an end face in contact with the fusible element and defining a central opening, the center portion further having a contoured lip with a radius of curvature extending from the end face into the central opening, the fusible element extending over the contoured lip, the contoured lip terminating in a free end that extends away from, and is not in direct, physical contact with, the fusible element such that the fusible element engages only a rounded surface of the contoured lip;

a plurality of spring legs extending from the center portion, the plurality of spring legs of the first inner cap in contact with the first side surface, and the plurality of spring legs of the second inner cap in contact with the second side surface; and a first endcap surrounding the first end and a second endcap surrounding the second end.

12. The protection device according to claim 11, wherein the plurality of spring legs of the first inner cap is in physical and electrical contact with an interior surface of first endcap, and wherein the plurality of spring legs of the second inner cap is in physical and electrical contact with an interior surface of the second endcap.

13. The protection device according to claim 11, wherein the inner cap is formed of sheet metal having a plurality of edges, and wherein the fusible element does not engage any of the edges.

14. The protection device according to claim 11, the contoured lip having a free end that extends away from the fusible element.

15. The protection device according to claim 11, wherein the center portion of the first inner cap comprises a first standoff feature extending towards the first endcap, and wherein the center portion of the second inner cap comprises a second standoff feature extending towards the second endcap.

16. The protection device according to claim 15, wherein the first standoff feature is in physical and electrical contact with the first endcap, and wherein the second standoff feature is in physical and electrical contact with the second endcap.

17. The protection device according to claim 11, wherein the plurality of spring legs of the first inner cap comprises:

a first bend in direct physical and electrical contact with the first endcap;

a second bend in direct physical contact with the first side surface; and a free end extending from the second bend, the free end angled away from the first side surface, and wherein the plurality of spring legs of the second inner cap comprises:

a first bend in direct physical and electrical contact with the second endcap;

a second bend in direct physical contact with the second side surface; and a free end extending from the second bend, the free end angled away from the second side surface.

18. A protection device comprising:

a hollow body including a first end and a second end, the first end including a first end surface and a first side surface extending from the first end surface, and the second end including a second end surface and a second side surface extending from the second end surface;

a fusible element disposed within a central cavity of the hollow body, the fusible element extending between the first and second ends;

a first inner cap formed over the first end, and a second inner cap formed over the second end, wherein the fusible element is connected to each of the first and second inner caps, and wherein the first and second inner caps each comprise:

a center portion having an end face in contact with the fusible element and defining a central opening, the center portion further having a contoured lip with a radius of curvature extending from the end face into the central opening, the fusible element extending over the contoured lip, the contoured lip terminating in a free end that extends away from, and is not in direct, physical contact with, the fusible element such that the fusible element engages only a rounded surface of the contoured lip;

a plurality of spring legs extending from the center portion, the plurality of spring legs of the first inner cap in contact with the first side surface, and the plurality of spring legs of the second inner cap in contact with the second side surface; and a first endcap surrounding the first end and a second endcap surrounding the second end, wherein the plurality of spring legs of the first inner cap are in contact with the first endcap, and wherein the plurality of spring legs of the second inner cap are in contact with the second endcap.

19. The protection device according to claim 18, the contoured lip having a free end that extends away from the fusible element.

20. The protection device according to claim 18, wherein the inner cap is formed of sheet metal having a plurality of edges, and wherein the fusible element does not engage any of the edges.

* * * * *